US006017238A

United States Patent [19]

Johnston

[11] Patent Number: 6,017,238

[45] Date of Patent: Jan. 25, 2000

[54] CONNECTOR ASSEMBLY AND METHOD FOR MAKING

[75] Inventor: James J. Johnston, St. Petersburg, Fla.

[73] Assignee: The Wiremold Company, West Hartford, Conn.

[21] Appl. No.: 09/094,308

[22] Filed: Jun. 9, 1998

[51] Int. Cl.[7] ..... H01R 4/24

[52] U.S. Cl. ..... 439/404

[58] Field of Search ..... 439/404, 417, 439/696, 692, 687

[56] References Cited

U.S. PATENT DOCUMENTS

| | | | |
|---|---|---|---|
| 3,184,354 | 5/1965 | Strother | 156/73 |
| 5,134,249 | 7/1992 | Adachi | 174/92 |
| 5,556,307 | 9/1996 | Johnston | 439/676 |

*Primary Examiner*—Michael L. Gellner
*Assistant Examiner*—Antoine Ngandjui
*Attorney, Agent, or Firm*—McCormick, Paulding & Huber LLP

[57] ABSTRACT

A patch cord assembly for plugging connection with an in-line array of insulation displacement connectors (IDC's) on a 110 cross-connect panel includes a plugging connector defining a plurality of plug receptacles separated from each other by contact supporting walls. Each supporting wall supports an associated elongated contact which defines a portion of the wall and has elongated contact surfaces exposed at opposite sides of the wall. The contacts extend in to the hollow housing and are terminated therein by individually insulated electrical conductors. An ultrasonic welding process strips insulation from end portions of the electrical conductors and simultaneously terminates the stripped end portions at the contacts and within the housing while the housing sections are being joined together in assembly by the ultrasonic welding process.

17 Claims, 8 Drawing Sheets

CONNECTOR ASSEMBLY AND METHOD FOR MAKING

BACKGROUND OF THE INVENTION

This invention relates in general to electrical connector assemblies and deals more particularly with an improved modular connector assembly for use in a telephonic and/or data signal transmission system and a method for making such an assembly.

The connector assembly of the present invention is particularly well suited for use as a patch cord on a cross-connect panel, as, for example, an AT&T 110 type panel. Such a cross-connect panel meets EIA/TIA Commercial Building Standards and provides a convenient centralized location for networking the communications and data processing systems within a building and for interconnecting the building systems with an outside telecommunication network.

A typical patch cord for a modem cross-connect panel system of the aforedescribed general type includes an elongated flexible stranded wire cord having a patch plug attached to each of its ends. The patch plug generally has a housing containing an in-line array of flat contact blades adapted to be simultaneously pressed or plugged into and extracted from an equal number of mating insulation displacement contacts (IDCs) mounted on and projecting from the cross-connect panel. Typically the contact blades within the plug housings are connected to individual stranded wire conductors in the patch cord by IDC terminations.

While stranded wire patch cords afford the advantages of flexibility, for ease of cable buildup during panel board installation, and enhance high frequency transmission performance, due to increased pair twisting capability, these advantages do not adequately compensate for the basic incompatibility of IDC technology and stranded wire. Further, the initial concept of mass termination to enhance efficiency by cross-connecting an entire network (four pair), as opposed to terminating individual conductors, is seriously flawed by insertion of eight relatively large flat formed blade contacts at each end of the patch cord into associated IDC slots on a cross-connect panel.

Accordingly, it is the general aim of the present invention to provide a connector assembly having improved plugging electrical contacts for releasable mating engagement with IDCs mounted on a cross-connect panel or the like. It is a further aim of the invention to provide an improved method for making a connector assembly having an in-line array of insulated electrical conductor to contact terminations which are simultaneously formed during connector housing assembly, whereby an improved connector assembly may be produced at a substantially lower cost than presently available connector assemblies of like kind.

SUMMARY OF THE INVENTION

In accordance with the present invention, an improved connector assembly for repeated plugging connection to and extraction from an in-line array of insulation displacement connectors (IDC's) has a plurality of elongated electrical contacts and a plug housing defining an in-line array of plug receptacles separated from each other by portions of the contacts and contact supporting walls which support the contacts. Each contact is supported by an associated pair of the contact supporting walls, forms extensions of the walls and has elongated contact surfaces exposed at its opposite sides. The contacts extend into and are terminated within the housing by individually insulated electrical conductors. The connector housing is formed by two housing sections joined together by an ultrasonic welding process. Insulation is stripped from end portions of the conductors which end portions are simultaneously clamped in electrically connected engagement to associated end portions of the contacts within the housing by the same ultrasonic welding operation employed to weld to housing sections.

DETAILED DESCRIPTION OF PREFERRED EMBODIMENT AND METHOD

Figure 1:
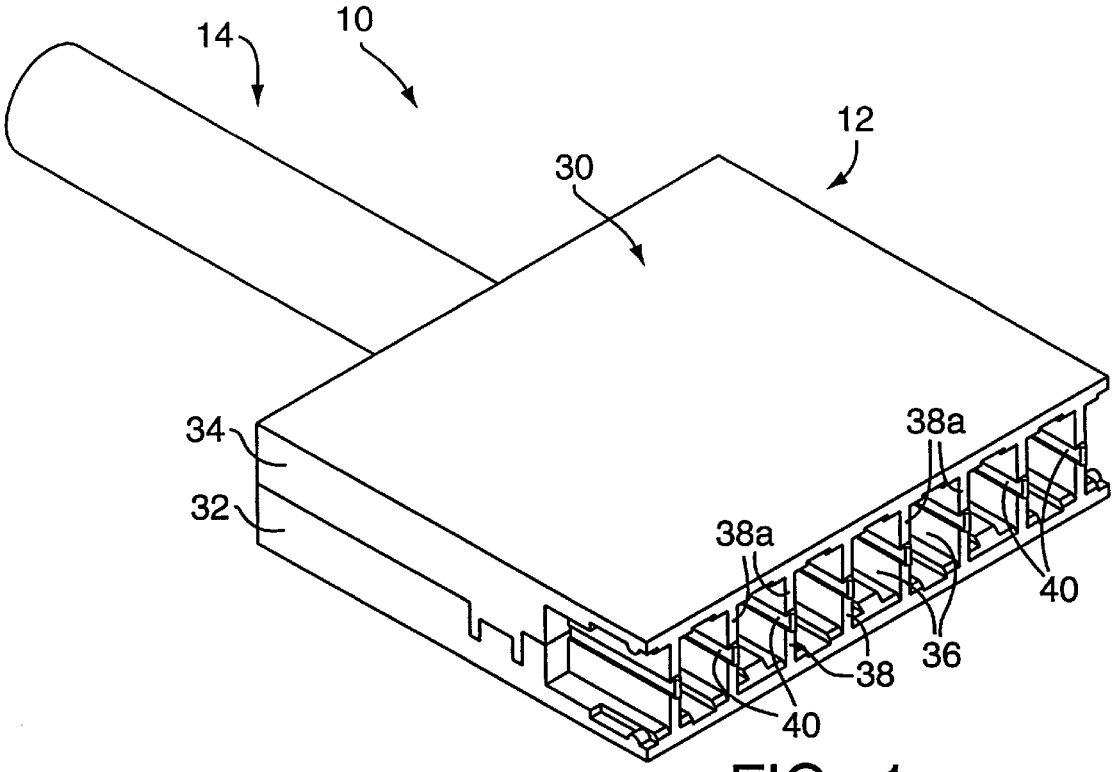
FIG. 1 is a fragmentary perspective view of a connector assembly embodying the present invention.
Figure 2:
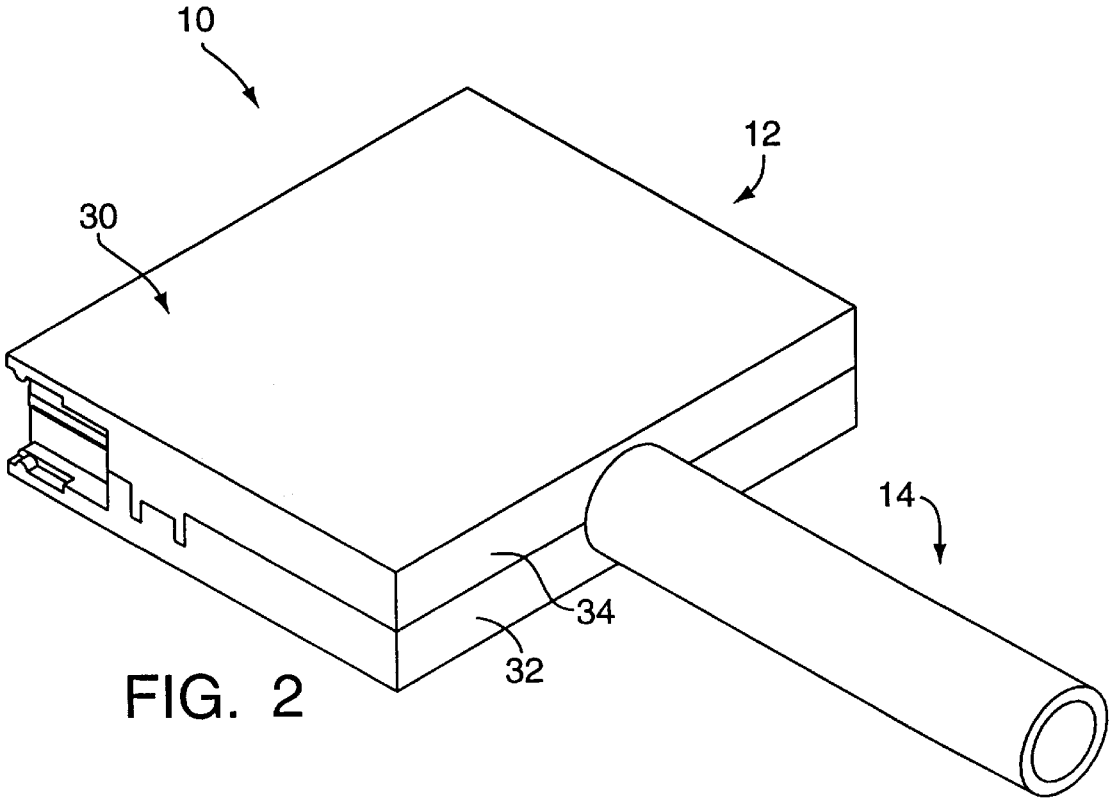
FIG. 2 is another perspective view of the connector assembly shown in FIG. 1.

Referring now to the drawings, an electrical connector assembly embodying the present invention is shown in FIGS. 1–2 and indicated generally by the reference numeral 10. The illustrated connector assembly 10 comprises a part of a cord set particularly adapted for use as a patch cord for a cross-connect panel of the type usually found in large office buildings and other commercial establishments for networking the communications and data processing systems within a building and interconnecting these systems with an outside telecommunications network. The patch cord assembly 10 is generally used to selectively simultaneously interconnect a plurality of individual wire conductors terminated at such a cross-connect panel and includes a modular connector or patch plug indicated generally at 12 and a flexible patch cord attached to the plug and designated generally by the numeral 14.

Figure 3:
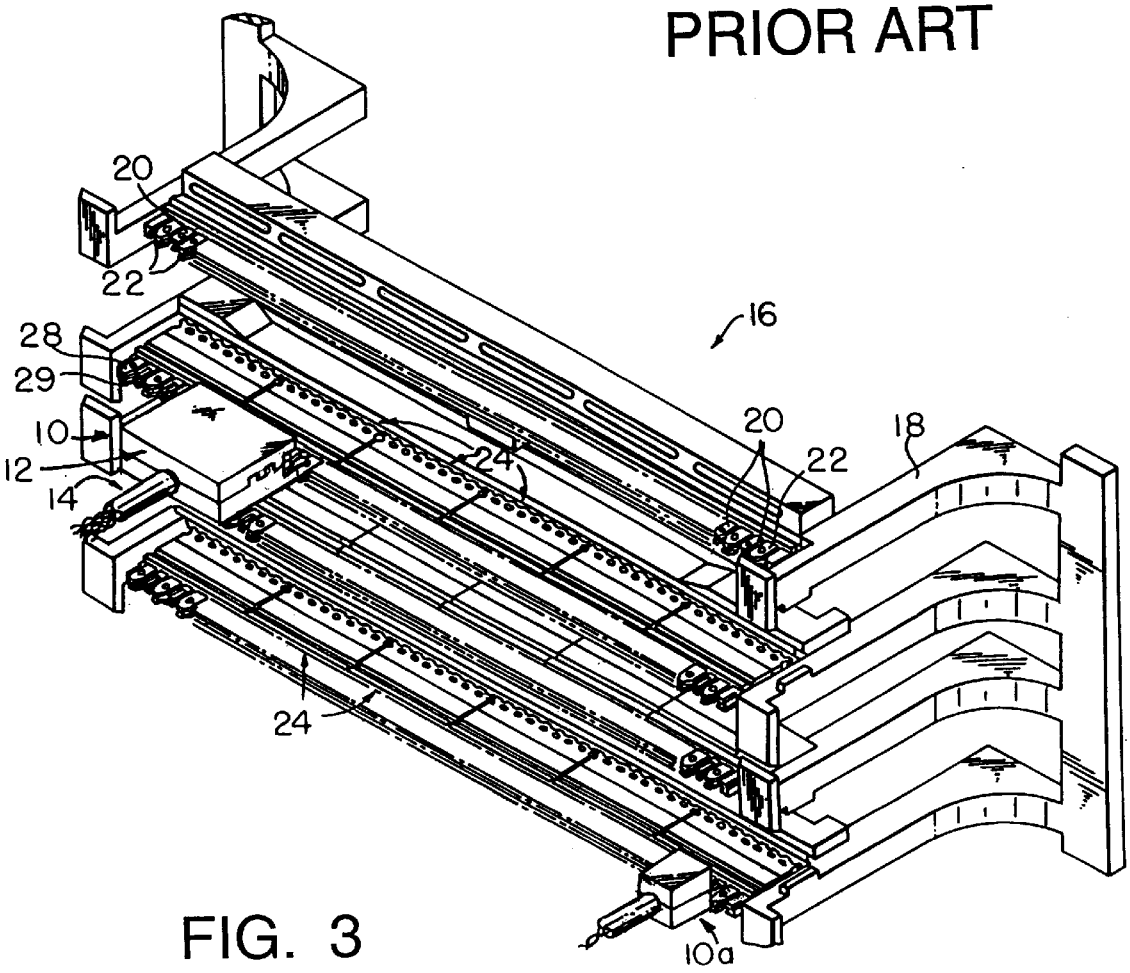
FIG. 3 is a perspective view of a typical cross-connect panel having four rows of attached connector blocks and shown with two cord sets attached thereto.

Before further considering the patch cord assembly 10 and to aid in an understanding to the invention, a cross-connect panel of the type with which the present patch cord assembly is used will be briefly described. A typical wall mounted cross-connect panel is shown in FIG. 3 and indicated generally by the reference numeral 16. The illustrated panel 16 is a typical AT&T 110 cross-connect panel (110 AWI-100) and, as shown includes a horizontally elongated frame 18 molded from dielectric plastic material. A plurality of horizontally extending rows of longitudinally spaced apart first plugging elements 20, 20 and 22, 22 project from the frame. End portions of individual wire conductors to be interconnected by patch cord assemblies at the cross-connect panel 16 are received in spaces between the first plugging elements 20, 20 and 22, 22 and terminated by connector blocks indicated generally at 24, 24 which carry double ended insulation displacement connectors (IDCs) and snap into lock-on engagement with the panel frame 18, in a manner well known in the telecommunication art.

Figure 4:
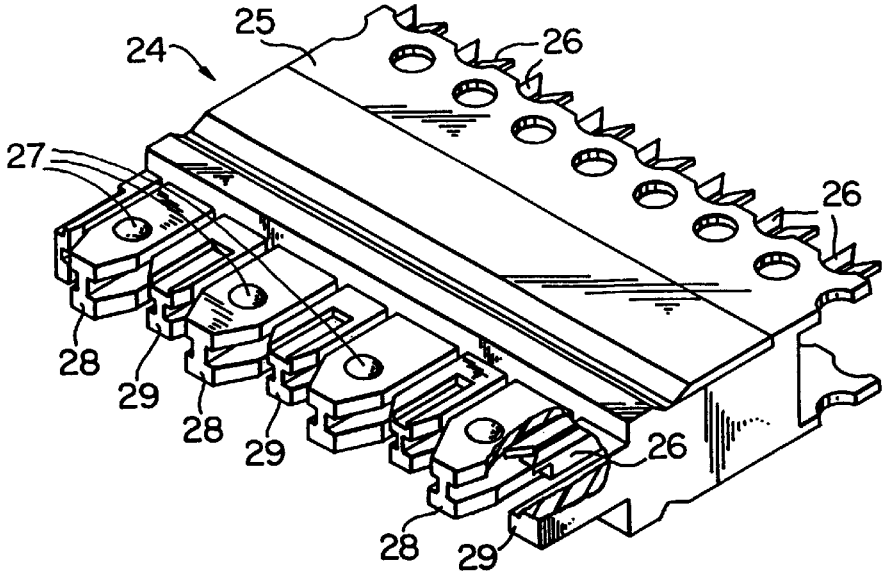
FIG. 4 PRIOR ART
FIG. 4 is a somewhat enlarged perspective view of a typical prior art connector block.

A typical connector block 24, shown in FIG. 4, has a dielectric body 25 and contains an in-line array of double ended connector elements 26, 26. Each connector element 26 has insulation displacement connectors (IDCs) at its opposite ends. The IDCs at the front ends of the connector elements 26, 26 project from the front or frame side of the connector block 24 and simultaneously terminate an in-line array of individual wire conductors positioned in spaces between associated first plugging elements 20, 20 and 22, 22 on the cross-connect panel frame 18 when the connector block 24 is pushed into snap-on locking engagement with the frame. The IDCs at the opposite or rear ends of the connector elements 26, 26 are exposed in spaces between second plugging elements 28, 28 and 29, 29 integrally formed on the rear end of the connector block body 25. Each plugging element 28 has a raised bump 27 on its upper surface and a similar bump 27 on its lower surface (not shown). The plugging elements 28, 28 and 29, 29 facilitate plugging connection with a patch plug such as the patch plug 12 which comprises part of the patch cord assembly 10.

Further considering the patch cord assembly 10 and referring again to FIGS. 1 and 2, the illustrated patch plug 12 has a hollow generally rectangular dielectric housing, indicated generally by the reference numeral 30, formed by the joinder of two discrete molded housing sections which include a lower section 32 and an upper section 34. The housing 30 has an in-line array of forwardly and outwardly open plug receiving recesses or receptacles 36,36 separated from each other by contact supporting walls 38, 38. Each pair of walls 38, 38 supports and elongated rearwardly extending electrical contact 40 which forms extensions of the walls which support it, as will be hereinafter further evident.

Figure 12:
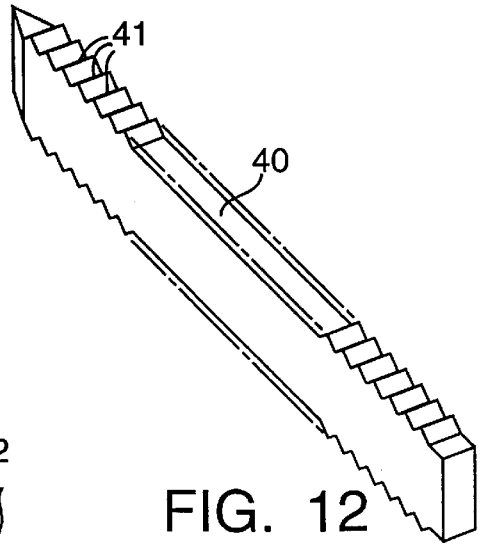
FIG. 12 is a somewhat enlarged perspective view of a typical contact bar.

A typical contact 40, as shown in FIG. 12, comprises an elongated bar of generally rectangular cross-section and has transverse serrations 41, 41 on its upper and lower surfaces. The serrations preferably extend along the entire length of the contact. A presently preferred contact bar 40 is formed with vertically disposed forwardly converging lead surfaces at the forward end thereof which form an included angle of approximately 45 degrees. Each contact bar 40 extends into the hollow housing 30 and is terminated within the housing by an associated individually insulated electrical conductor C which forms a part of the flexible patch cord or cable 14. The number of electrical contacts provided on a patch plug made in accordance with the present invention may vary. A patch cord made in accordance with the invention may, for example, include a single pair of contacts. However the illustrated patch cord 10 is adapted to interconnect four pair of conductors, therefore the patch plug 12 has eight contact bars 40, 40, each contact bar being supported by an associated pair of contact supporting walls 38, 38.

The upper and lower housing sections 32 and 34 are made from a thermoplastic engineering plastic particularly adapted for high temperature applications, a polyester, such as polybutylene terephthalate, being presently preferred. Each of the individually insulated flexible electrical conductors C, C, shown in FIG. 7, which comprise the cable 14, is a stranded conductor covered by thermoplastic insulating material which has a melting temperature substantially lower than the melting temperature of the engineering plastic from which the housing 30 is made. A flexible electrical cable made with a thermoplastic polymer insulation such as polyolefin has proven most satisfactory for use in practicing the invention. The two housing sections 32 and 34 are joined together in assembly by a high frequency vibratory energy welding process which also simultaneously removes or "strips" electrical insulation from an end portion of each of the aforementioned individually insulated electrical conductors C, C and terminates each of the latter conductors in electrically connected engagement with an associated terminal end portion of one of the contact bars 40, 40, within the connector housing 30 all of which will be hereinafter more fully described.

Figure 13:
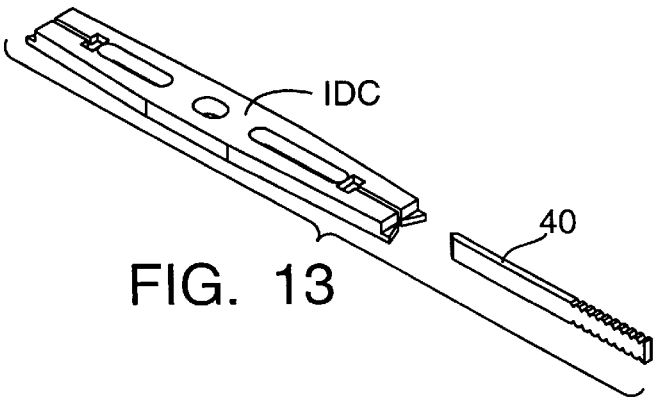
FIG. 13 is a somewhat enlarged exploded perspective view of a typical contact bar shown in entry or plugging relation to an insulation displacement contact.

When the patch plug 12 is disposed in plugging engagement with a connector block, such as the previously described connector block 24, each electrical contact bar 40 is disposed between and engaged by the blades of an associated one of the insulation displacement contacts (IDCs) 26 on the connector block 24. It should be noted that the elongated rearwardly extending contact bars 40, 40 are configured for ease of insertion between and generally longitudinal engagement with the elongated forwardly extending IDC contact blades to maximize surface-to-surface contact between the exposed laterally outwardly facing flat side surfaces on the rectangular contact bars 40, 40 and the opposing laterally inwardly facing surfaces on the IDC blades. The advantages attained by the particular configuration and arrangement of the contacts 40, 40 will be apparent from FIG. 13 where a typical contact 40 is shown in entry relation to a typical IDC.

Figure 5:
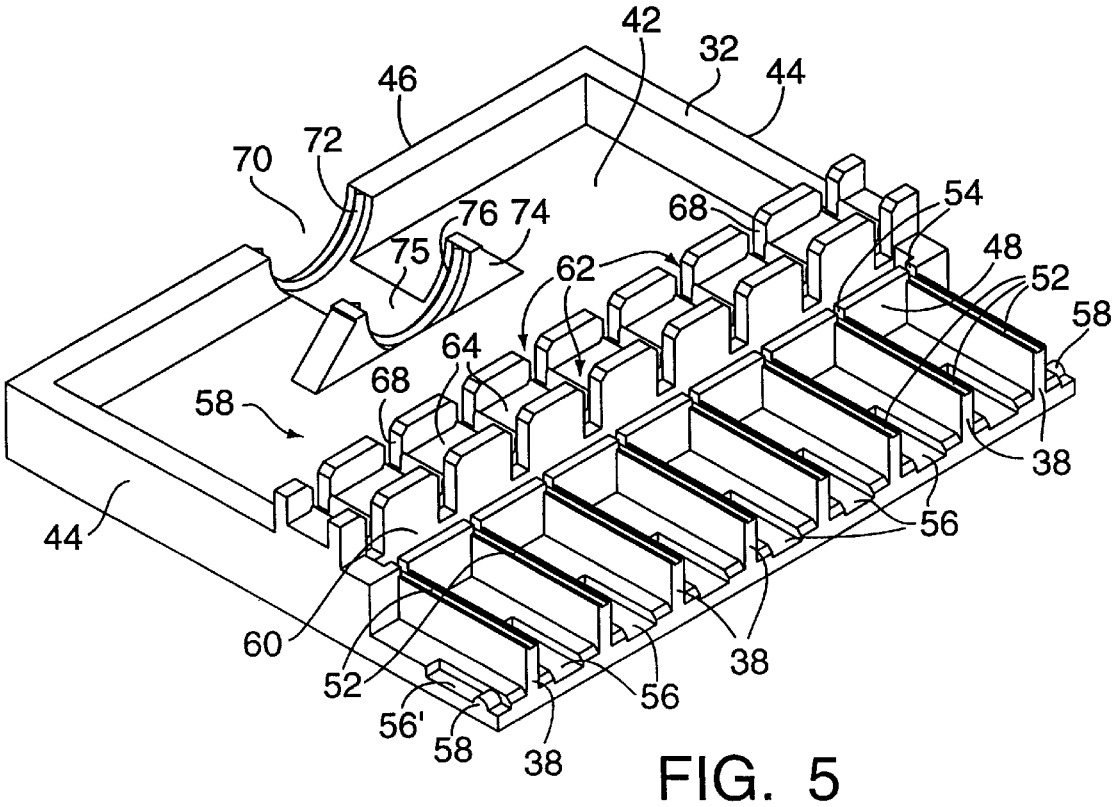
FIG. 5 is a perspective view of the lower section of the patch plug housing.
Figure 8:
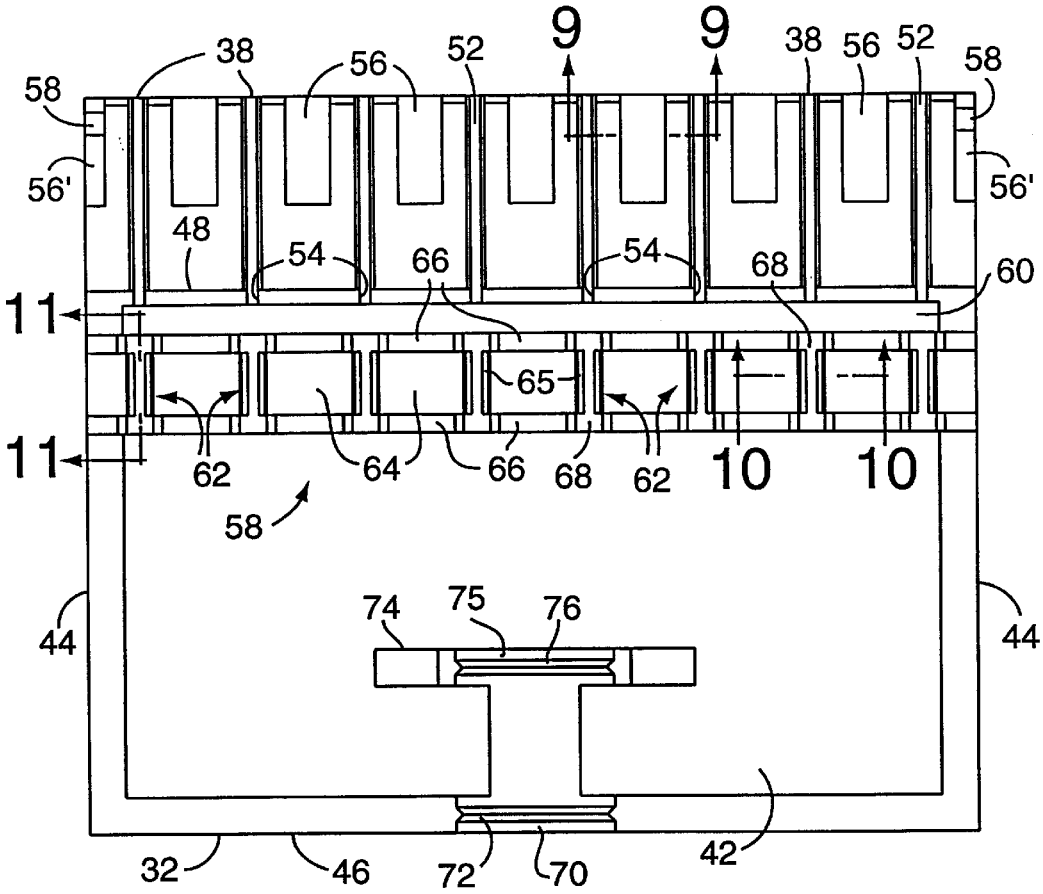
FIG. 8 is a somewhat enlarged top plan view of the housing lower section.
Figure 9:
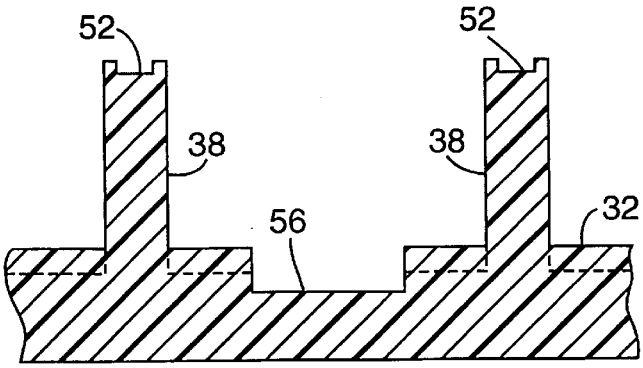
FIG. 9 is a somewhat further enlarged sectional view taken along the line 9, 9 of FIG. 8.

Referring now to FIGS. 5 and 8 the housing lower section 32 has a generally rectangular bottom wall 42, a pair of opposing side walls 44, 44 which terminate in rearwardly spaced relation to the forward edge of the bottom wall 42, and a rear wall 46 which connected to and extends between the rear ends of the side walls 44, 44. A dividing wall 48 projects upwardly from the bottom wall 42 and extends between and connects the forward ends of the side walls 44, 44. The upwardly facing surfaces of the side walls 44,44, rear wall 46, and dividing wall 48 lie substantially within a common plane.

Lower contact supporting walls 38, 38 are formed on the housing lower section 32. The lower contact supporting walls extends upwardly from the bottom wall 42 and in a forward direction from the dividing wall 48 and terminate at the forward edge of the bottom wall. The upwardly facing surfaces of the lower contact supporting walls 38, 38 lie within a common plane parallel to but somewhat below the plane defined by the upwardly facing surfaces of the side walls 44, 44, the rear wall 46 and the dividing wall 48. Each lower wall 38 has an upwardly open contact bar receiving groove 52 extending along its entire length. Each groove 52 has a generally rectangular cross-section for generally complementing the cross-section of a serrated lower end portion of a contact bar 40 to be received therein. A plurality of upwardly open slots 54, 54 equal in number to the lower contact supporting walls 38, 38 are formed in the dividing wall 48. Each slot 54 is aligned with and forms a rearward extension of an associated contact bar receiving groove 52.

A plurality of forwardly and upwardly open recesses 56, 56 are formed in the bottom wall between the contact supporting walls 38, 38, substantially as shown in FIG. 5, to receive bumps 27, 27 when the patch plug 12 is plugging engagement with a connector block such as the illustrated connector block 24. Half recesses indicated at 56' open forwardly and laterally outwardly at laterally opposite ends of the bottom wall 42. Raised ribs 58, 58 project from the bottom wall 42 within the half recesses 56', 56' for cooperating with associated bumps 27, 27 on the illustrated connector block 24 to releasably retain the patch plug 12 in snap-on engagement with the connector block.

A cradle, indicated generally at 58, projects upwardly from the bottom wall 42 and extends longitudinally of the housing lower section 32 between the side walls 44, 44 in rearwardly spaced relation to the dividing wall 48. A portion of the forwardly facing surface of the cradle 58 cooperates with the rearwardly facing surface of the dividing wall 48 and portions of the inner surfaces of the bottom and side walls to define a trough 60 immediately forward of the cradle, for a purpose that will be hereinafter explained. A longitudinally spaced apart series of crimp barrels or slots 62, 62 formed in the cradle 58 open upwardly through the upper surface of the cradle, the latter surface being indicated at 64. A pair of energy directors 65, 65 project upwardly from the cradle surface 64 at opposite sides of the crimp barrel 62 and extend transversely of the cradle 58 between a pair of upwardly projecting guiderails 66, 66, substantially as shown. These energy directors preferably have an apex angle of 60 degrees. Each crimp bore 62 is disposed rearwardly of an in alignment with an associated contact bar receiving groove 52. It should be noted that the cradle surface 64 is disposed within a plane above the plane defined by the upwardly facing surfaces of the rear wall, side walls and the dividing wall.

Figure 10:
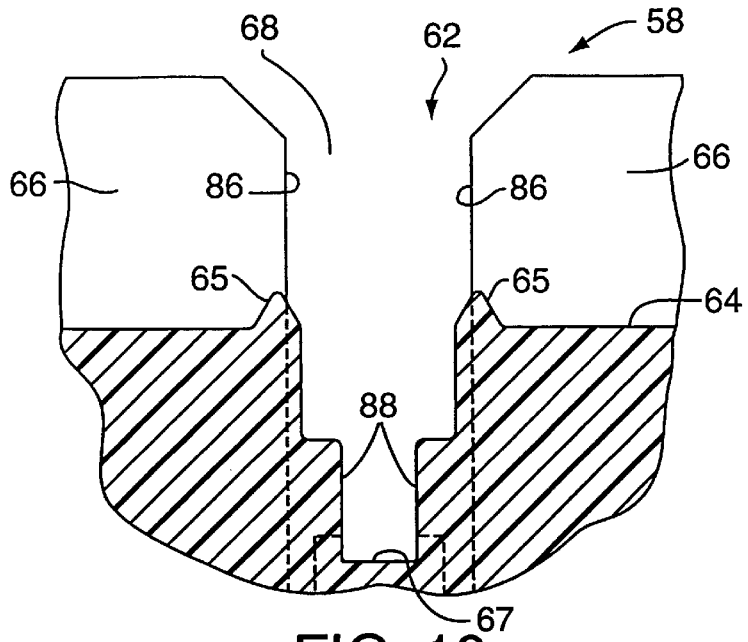
FIG. 10 is a somewhat enlarged sectional view taken along the line 10, 10 of FIG. 8.
Figure 11:
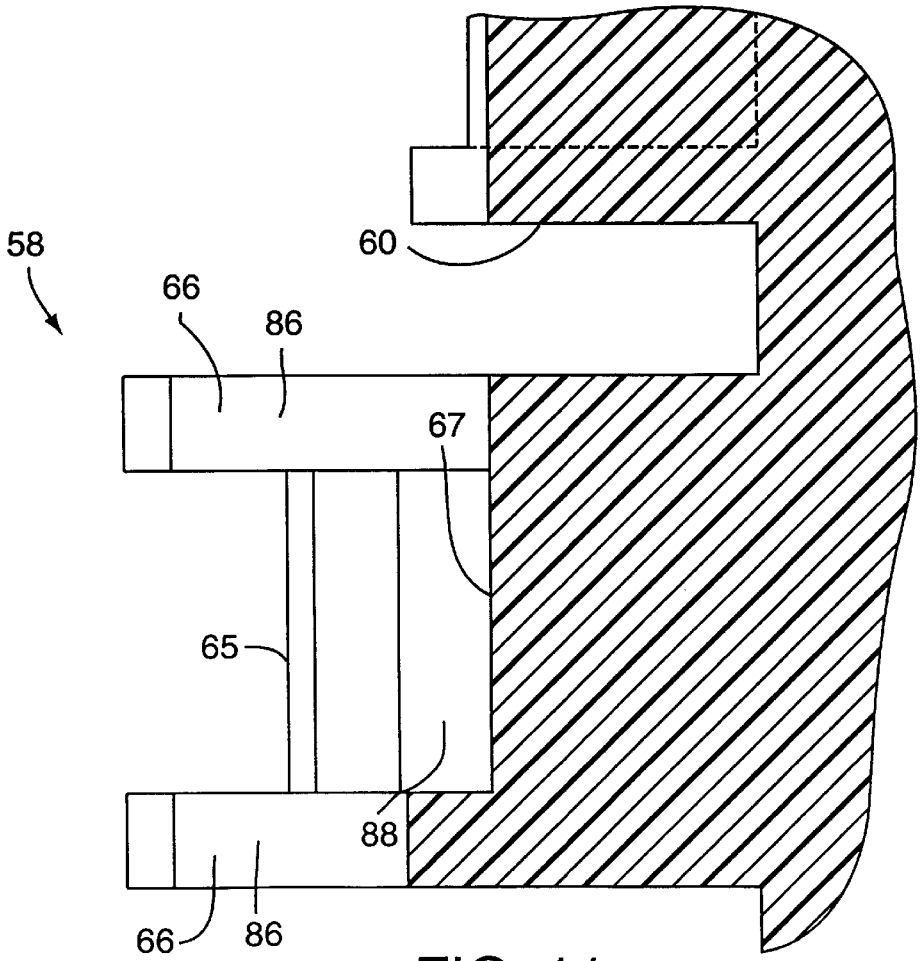
FIG. 11 is a somewhat enlarged sectional view taken along the line 11, 11 of FIG. 10.
Figure 14:
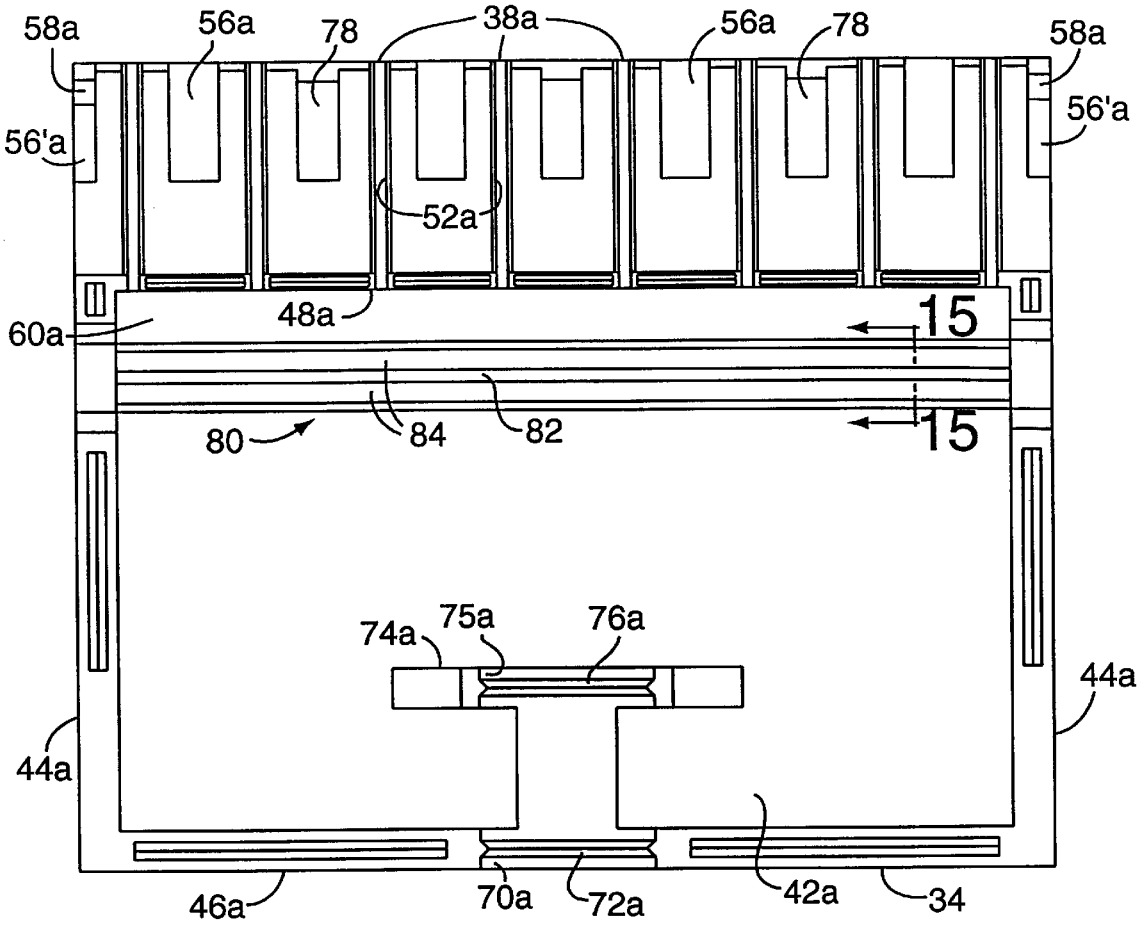
FIG. 14 is a somewhat enlarged bottom plan view of the housing upper section.

A typical crimp bore 62, shown in FIG. 10 comprises a downwardly stepped slot which has a the lower end surface 65 in horizontal alignment with the lower surface of an associated contact bar receiving groove 52. The lower portion of the slot has a width substantially equal to the width of an associated contact bar 40. The upper portion of the slot is somewhat wider than the lower portion and has a width or slightly larger than the nominal diameter of an uninsulated portion of an associated electrical conductor C to be received therein. The pair of guiderails, 66, 66 integrally formed on the cradle 58 extend upwardly at the forward and rear ends of the cradle surface 64, or more specifically at the opposite ends of the crimp barrels 62, 62. Each guiderail 66 has a plurality of upwardly open guide slots 68, 68 therein equal in number to the number of crimp barrels 62, 62. Each guide slot has a width slightly greater than the width of the upper portion of the crimp slot 62 with which it is aligned. The guide slots 68, 68 at the forward end of the cradle open into the trough 60. The cradle 58 and its function will be hereinafter more fully discussed.

Figure 6:
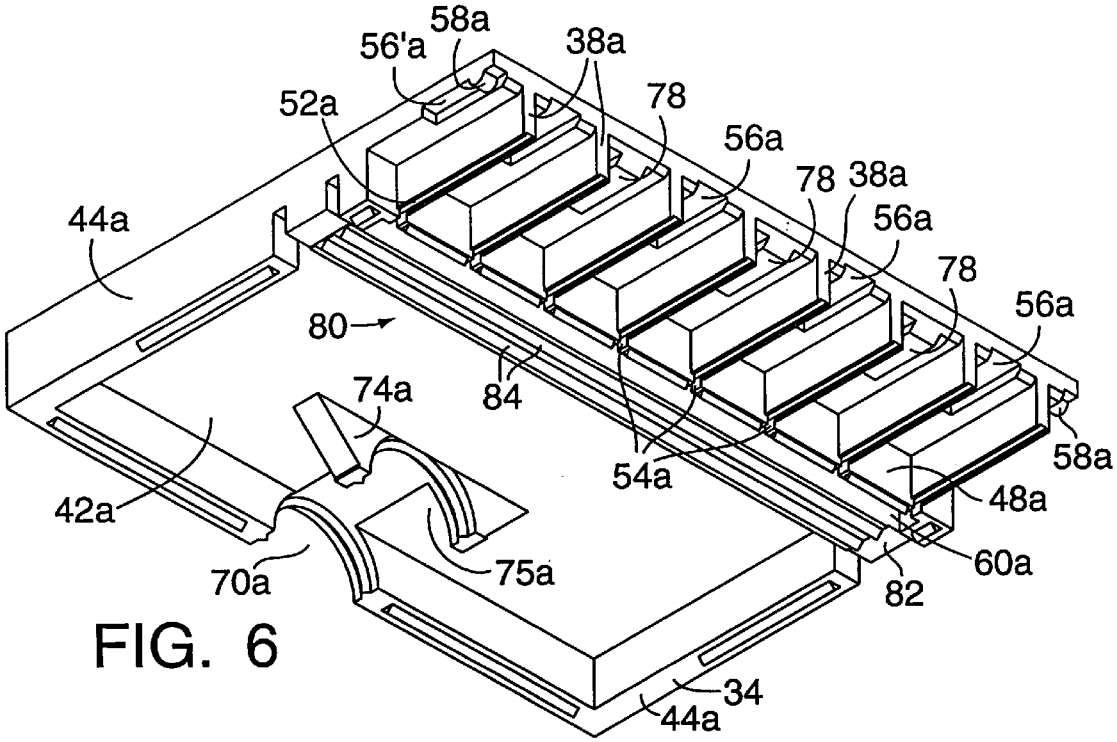
FIG. 6 is a perspective view of the upper section of the patch plug housing.

Further referring particularly to FIGS. 6 and 8 the lower housing section 32 has a generally semi-cylindrical upwardly open cable entry slot 70 formed in the rear wall 46 for receiving and retaining an associated portion of the patch cord 14. A generally semi-circular energy director 72 of substantially triangular cross-section projects radially inwardly from its inner surface of the cable entry slot and extends therealong, substantially as shown. The lower housing section 32 also has an internal cable support member 74 which projects upwardly from the bottom wall 42 in forwardly spaced relation to the cable entry slot 70 and defines another semi-cylindrical cable receiving slot 75. The cable receiving slot 75 also includes an energy director 76 similar to the energy director 72 previously described.

The housing upper section 34 is a near mirror image of the previously described housing lower section 32 and parts of the upper section which corresponds to parts of the lower section are identified in the drawings by the same reference numerals with a letter "a" suffix and will not be hereinafter described in detail. However, the housing upper section differs from the lower section in some important respects and these differences will be discussed.

Referring now particularly to FIG. 6 the upper housing section has a top wall 42*a*, side walls 44*a*, 44*a*, a rear wall 46*a* and a dividing wall 48*a*. The latter walls have downwardly facing surfaces disposed within a common plane for registry with the upwardly facing surfaces on the corresponding walls of the housing lower section 32. Elongated energy directors of substantially triangular cross-section extend along the various downwardly facing wall surfaces of the housing upper section 34 hereinbefore described. The housing upper housing section 34 also has upper contact supporting walls 38*a*, 38*a* which comprise mirror images of the lower contact supporting wall sections 38, 38 and which cooperate with the corresponding lower contact supporting walls to support contacts 40, 40 there between. As on the lower section 32, downwardly open recess 56*a*, 56*a* are formed in the top wall 42*a* to receive raised bumps 27, 27 on plugging elements of a connector block, such as the connector block 24. However, to assure proper polarity and correct mating engagement relative to an AT&T 110 panel when the patch plug 10 is plugged into engagement with such a panel, bosses 78, 78 depend from the top wall 42*a* between certain of the walls 38, 38 for cooperating with recesses in certain of the plugging element on an associated connector block mounted on the 110 panel. The housing upper section 34 further differs from the lower housing section 32 in that it has an energy director cap indicated generally at 80 for cooperating with the cradle 58 on the lower housing section 32 when the two housing sections are joined together in assembly, as will be hereinafter more fully discussed.

The energy director cap 80 depends from the top wall 42*a* and extends longitudinally across the upper housing section 34 in rearwardly spaced relation to the dividing wall 48*a* and cooperates with the dividing wall 48*a* to form an upward extension of the trough 60 indicated at 60*a* when the clam-shell like connector housing 30 is assembled from the upper and lower housing sections 34 and 32. The energy director cap 80 has a downwardly facing surface 82 disposed in a plane spaced above the plane defined by the downwardly facing surfaces of the side walls 44*a*, 44*a*, the rear wall 46*a* and dividing wall 48*a*. The width of the energy director is substantially equal to the width of the cradle surface 64. Thus, when the two housing sections are brought together in assembly the cradle surface 64 and the energy director cap surface 82 are arranged to ultimately attain a position of confronting relationship with respect to each other, as will be evident from the further description which follows.

Figure 15:
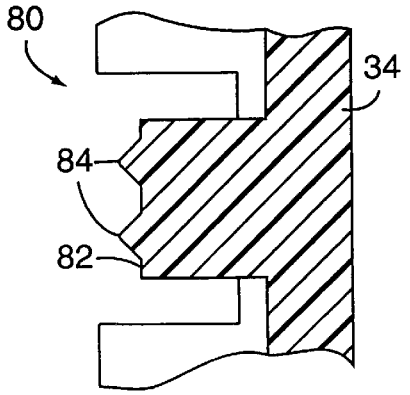
FIG. 15 is a somewhat enlarged fragmentary sectional view taken along the line 15, 15 of FIG. 14.

A pair of parallel energy directors 84, 84 depend from the energy director cap surface 82, extend longitudinally along the length of the energy director cap 80 between the side walls 44*a*, 44*a* and terminate proximate the side walls, as best shown in FIG. 6. The energy directors 84, 84 have an apex angle of approximately 90°, as shown in FIG. 15.

Notches formed in the side walls 44*a*, 44*a* to receive and complement opposite end portions of the guiderails when the housing sections 32 and 34 are brought together in assembly and assure proper registry of the energy director cap 80 with the cradle 58.

Figure 7:
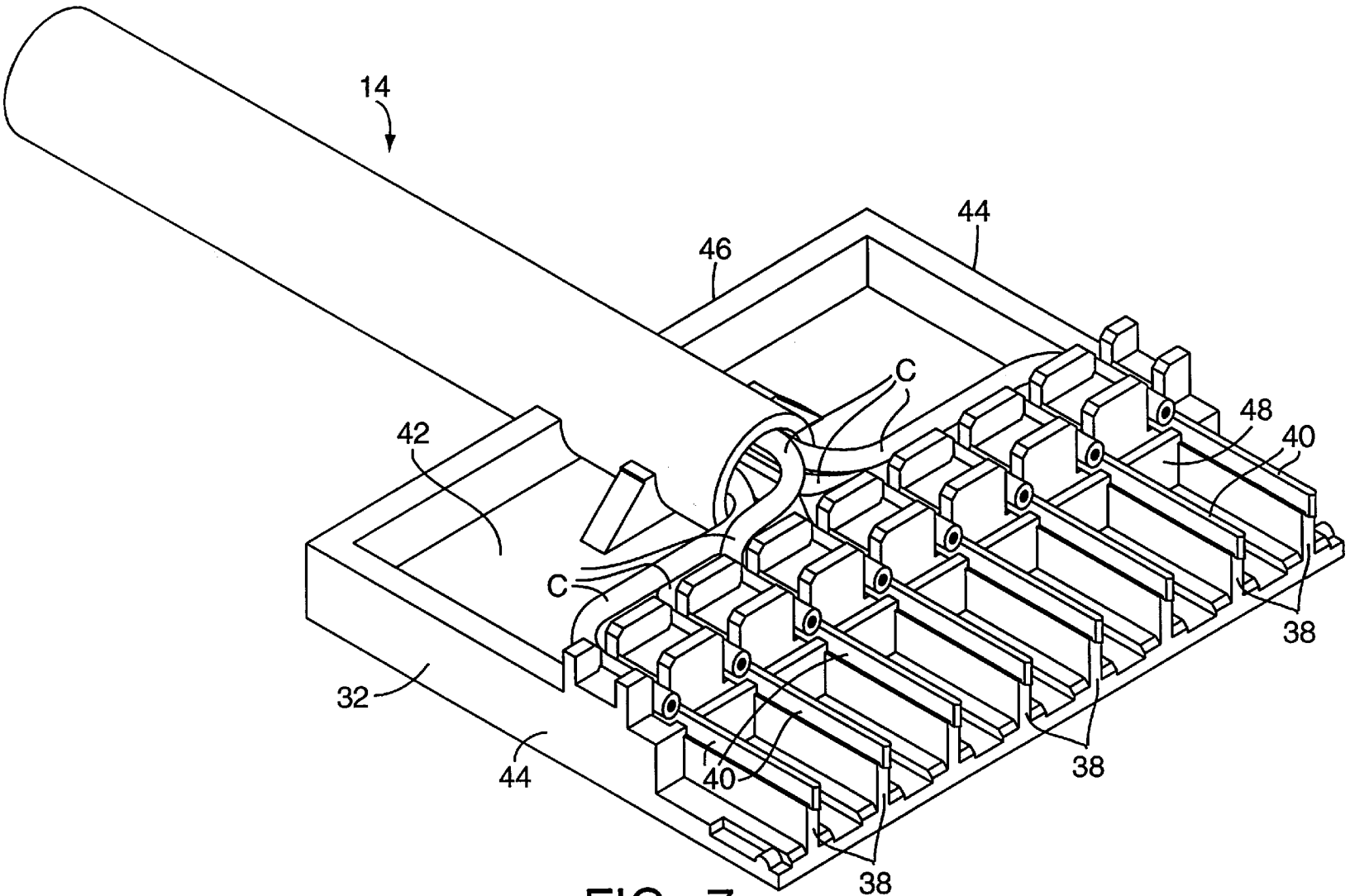
FIG. 7 is similar to FIG. 5 but shows the patch cord and contacts positioned within the lower section of the housing in preparation for assembly.

Preparatory to assembling the connector assembly 10, each contact bar 40 is positioned within a respectively associated contact receiving groove 52. A portion of the outer insulation jacket is removed from an end portion of the patch cord or cable 14 to expose the individually insulated electrical conductors C, C, therein. The insulated end portions of the connectors C, C, are next arranged within the guide slots 68, 68 in the cradle rails above the crimp barrel slots 62, 62. The conductors C, C, which are or may be color coded, are arranged in proper sequence, as necessary, to assure proper polarity, in a manner well known in the telecommunication art. The cable 14 is positioned within the entry slot 70 and the internal rib support slot 75. After the cable and individual contacts have been properly positioned within the lower housing section 32, substantially as shown in FIG. 7, the free end portions of the insulated conductors may be trimmed, as necessary, to assure proper mating engagement of the housing upper section 34 with the housing lower section 32 without risk of interference. The housing upper section 34 is then positioned on the housing lower section 32. The end portions of the guide rail on the lower housing section enter the complementary slots in the upper housing section thereby assuring proper alignment of the two housing sections during assembly. The preassembled housing sections with the cable 14 positioned therein are then preferably clamped or otherwise secured together in preassembled condition in preparation for the final assembly operation. A rubberband or other appropriate clamping means may be employed for this purpose. In this manner a supply of preassembled units may be prepared for production assembly. The final assembly operation is performed by an ultrasonic welding machine.

As previously noted the lower and upper housing sections 32 and 34 are joined together in assembly by an ultrasonic welding process to form the connector housing 30. However, in accordance with the present invention the insulated end portions of the conductors C, C to be contained within the formed housing are simultaneously stripped of insulation and electrically connected to the inner-end portions of the contact bars 40, 40 by the same ultrasonic welding process employed to join the two housing sections in assembly. A proper understanding of the process whereby the insulated conductors are simultaneously stripped and terminated requires further consideration of the cradle 58 and energy director cap 80 and the manner in which these elements are constructed and arranged to interact with the conductors C, C and contact 40, 40 during the ultrasonic welding process.

Figure 17:
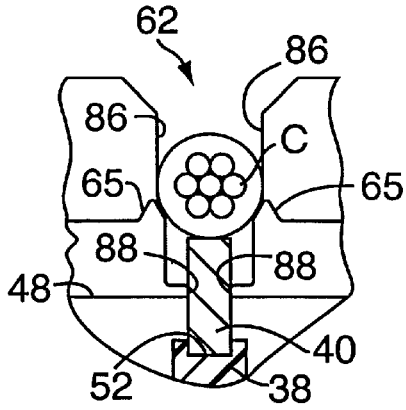
FIG. 17 is a somewhat schematic view and shows an electrical connection in an initial stage of assembly.
Figure 18:
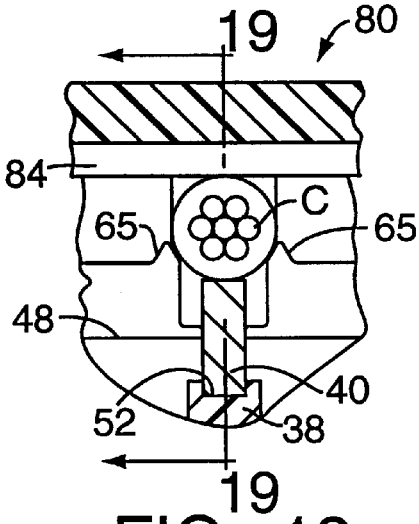
FIG. 18 is similar to FIG. 17 but shows a further stage of assembly.
Figure 19:
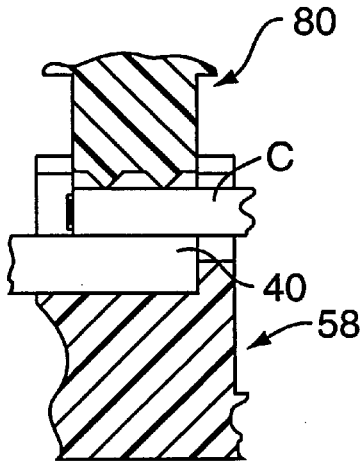
FIG. 19 is a sectional view taken along the line 19, 19 of FIG. 18.
Figure 20:
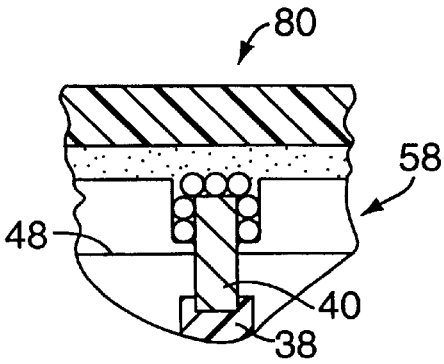
FIG. 20 is similar to FIG. 17 but shows a final stage of assembly.

Referring now to FIG. 17 a typical crimp barrel slot 62 is illustrated and has opposing side walls 86, 86 and a bottom or inner-end wall 88. The inner-end of the slot is shaped to substantially complement an associated portion of the contact bar 40, the inner-end portion of which is received within the crimp barrel slot 62. The illustrated crimp barrel is particularly adapted to receive a conventional flexible seven strand soft copper wire conductor of generally circular cross-section, which may, if desired, be plated with precious metal. The width dimension of the crimp barrel, as measured between the side walls 86, 86 is preferably slightly greater than the nominal dimension of the associated stranded wire conductor C.

The depth of the crimp barrel slot 62 is predetermined by physical characteristics and dimensions of the portion of the conductor of conductors to be received therein. Thus, for example, the conductors is an axially elongate stranded soft copper wire conductor, such as the seven strand conductor C, which undergoes significant physical and cross-section dimensional change when subjected to a radially directed compressive force within the range contemplated by the method of the present invention, this factor must be considered in determining the required slot depth. This change in cross-sectional dimension produced by application of a force of known magnitude, hereinafter referred to as the compressibility factor, is determined for at least one of the particularly conductors to be joined and is employed in determining the optimum depth dimension of the crimp barrel slot.

Figure 16:
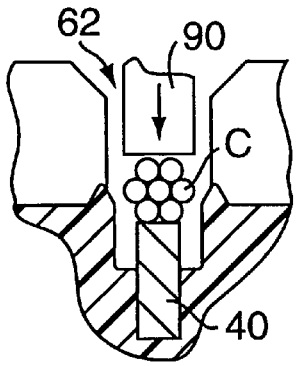
FIG. 16 is a somewhat schematic view of a testing apparatus for determining the compressibility factor of a conductor.

Referring now to FIG. 16, the compressibility factor for the conductor C may, for example, be determined by providing a test sample having a test slot similar to the slot shown in FIG. 10, a width dimension substantially corresponding to the nominal cross-sectional dimension of a stranded wire conductor C and a bottom or inner end wall which complements an associated lower portion of a contact 40, substantially as shown. A downwardly directed force of a magnitude within the anticipated range to be employed in assembling the electrical connection 10 in an ultrasonic welding machine is applied to the conductor C by a ram 90 received within and guided by the crimp barrel slot 62 and having a lower bearing surface for engaging the conductor C within the crimp barrel slot. The resulting compressibility factor, which may be expressed as a percentage change in the nominal cross-sectional dimension of the stranded wire conductor C measured in the direction of the applied force and in response to a force of known magnitude may then be utilized to determine the required depth dimension of the crimp barrel slot 62, that is the position of the slot to be occupied by the conductor C.

The depth of the slot should be equal to the height of the stacked conductor C and contact 40 within the slot less a percent of the nominal diameter of the stranded wire conductor 14 (i.e. less the compressibility factor).

The compressibility of the relatively hard wire contact 40 is substantially negligible as compared to that of the softer compressible stranded wire conductor C. Current results indicate that a most satisfactory junction can be formed considering only the compressibility factor for the softer more readily compressible stranded wire component in determining the required depth dimension of the crimp barrel slot 62. It should now be apparent that when the invention is practiced with other relatively compressible conductors, as, for example, nineteen strand soft stranded copper wire conductors, appropriate consideration of the compressibility factor will be essential to proper design of the terminal section.

As previously noted, the melting temperature of the electrical insulating material on the conductors C, C used in practicing the invention is substantially lower than the melting temperature of the engineering plastic material from which the molded housing sections which comprise the electrical connector housing 30 are formed. Consequently, during the initial stages of the ultrasonic welding operation and while the insulated wire end portions are disposed within the guide slots a substantial softening of the electrical insulation material on the various electrical conductors will occur as initial pressure of the energy director cap is applied to the various conductors C, C and before the conductors C, C enter the crimp barrels. Since the width of each crimp barrel closely approximates the nominal diameter of a wire conductor, as each conductor enters the crimp barrel the insulating material on the conductor will be displaced in the direction of the trough 60. It will be evident that the substantially solid insulation material on the conductors at the rear of the crimp barrel will resist rearward displacement of the material within the crimp barrel so that softened insulating material will have a tendency to be displaced in a forward direction toward and into the trough 60. This condition occurs before any substantial softening or ultimate melting of the plastic material from which the cradle 58 and energy director cap 80 are formed.

The stranded wire conductor C, which is softer than the contact material undergoes some deformation and substantially fills the crimp barrel and extends for some distance upwardly and outwardly from the crimp barrel. The energy directors on the cap bridge the crimp barrel and continue to apply downwardly directed force to the stranded conductor during the welding assembly cycle. While the sections 32 and 34 are maintained in compression by the ultrasonic welder, high frequency vibratory energy is applied to the sections to soften the various thermoplastic energy directors and associated portions of the confronting surfaces on the cradle 58 and cap 80 to provide molten thermoplastic material at the interface between the energy director cap and the cradle as well as at the other confronting surfaces of the upper and lower housing sections 34 and 32.

Application of high frequency vibratory energy ceases while the sections are maintained in compression allowing the molten thermoplastic materials at the interface between the housing sections and at the interface between the cradle 58 and the energy director cap 80 to solidify forming welds joining the thermoplastic housing sections 32 and 34 and resulting in a substantial encapsulation of the coengaging end portions of the conductor C and the contact bar 40 within the housing. The ultrasonic welding operation also causes portions of the energy directors which bridge the crimp barrel to melt in the regions of the crimp barrel. This molten material flows into and is redistributed within the crimp barrel filling any voids which may remain therein after metal-to-metal contact has been established between the various conductor strands and the contact 40. Some hermetic sealing occurs in the area around the contact and associated conductor which prevents corrosion in these regions and aids in preserving the integrity of the resulting electrical connection.

Proper slot dimensioning is critical to ensure proper termination. Each application must be analyzed and evaluated in terms of the compressibility factor for each metal conductor to be terminated. The slot depth must be equal to the combined height of the stacked conductors within the groove after compression or deformation of these conductors (i.e. after assembly). To assure attainment of terminations having high degrees of integrity each insulated conductor C should be well supported in alignment with but substantially outside of an associated crimp barrel slot 62 during the initial phase of the ultrasonic welding operation, so that proper softening displacement of the electrical insulation material on the conductors can occur as the conductors enter the crimp barrel slots.

The present invention has been illustrated and described with reference to a method whereby stranded insulated conductors are terminated to solid wire contacts as part of a connector assembly process. However, it should be understood that terminations of other types may be formed in accordance with the present invention. Thus, for example, solid wire connectors may also be joined to solid contacts and or other conductors in accordance with the method of the present invention. Further information relating to methods for joining conductors of both solid and stranded types will be found in my U.S. patent application Ser. No. 08/393,843, now U.S. Pat. No. 5,857,259 entitled Method For Making Electrical Connection issued Jan. 12, 1999 and assigned to the assignee of the present invention and which is hereby adopted by reference as part of the present disclosure.

I claim:

1. An electrical connector assembly comprising a hollow connector housing including a plurality of substantially parallel spaced apart contact supporting walls partially defining an in-line array of outwardly open plug receptacles, a plurality of elongated plugging electrical contacts, said contacts being supported by and forming extensions of said contact supporting walls, said contacts having elongated contact surfaces exposed at opposite sides thereby and within said receptacles, said contacts extending into said hollow housing, and a plurality of insulated electrical conductors, each of said conductors being electrically connected to and terminated by an associated one of said contacts within said housing.

2. An electrical connector assembly as set forth in claim 1 wherein each of said contacts has an exposed outer end portion defined by a pair of outwardly converging outer end surfaces.

3. An electrical connector assembly as set forth in claim 1 wherein said housing comprises mating ultrasonically weldable dielectric housing sections ultrasonically welded together in assembly.

4. An electrical connector assembly as set forth in claim 3 wherein each of said contacts is supported by and between opposing edge portions of a pair of contact supporting walls carries by said mating housing sections.

5. An electrical connector assembly as set forth in claim 4 wherein each of said opposing edge portions has a groove receiving an associated portion of a contact therein.

6. An electrical contact assembly as set forth in claim 5 wherein each of said contacts has transversely extending serrations disposed along at least a portion of its length.

7. An electrical conductor assembly as set forth in claim 3 wherein one of said housing sections includes an integral cradle formed thereon and continued therein, said cradle has crimp barrels formed therein, another of said housing sections has an integral energy director cap for cooperating in assembly with said cradle, and said electrical conductors are terminated to said contacts within said crimp barrels by the ultrasonic joinder of said energy director cap to said cradle when said housing sections are ultrasonically welded together in assembly.

8. An electrical connector assembly as set forth in claim 7 wherein said electrical conductors comprise insulated conductors having terminated portions in electrical contacting engagement with said contacts and from which terminated portions insulation is heat stripped when said housing sections are ultrasonically welded together in assembly.

9. An electrical conductor assembly as set forth in claim 8 including means for receiving said insulation material heat stripped from said terminated portions when said housing sections are ultrasonically welded together in assembly.

10. An electrical conductor assembly as set forth in claim 9 wherein said means for receiving said heat stripped insulation comprises a trough formed by portions of said housing and said cradle.

11. An electrical conductor assembly as set forth in claim 7 wherein said conductors comprise a part of an electrical cable having an ultrasonically weldable jacket and extending from said housing and said jacket is ultrasonically welded to said housing when said housing sections are ultrasonically welded together in assembly.

12. An electrical conductor assembly as set forth in claim 11 wherein said housing section have integral internal cable support members therein and said internal cable support members are ultrasonically welded to said jacket when said housing sections are ultrasonically welded together in assembly.

13. An electrical connector assembly comprising a hollow connector housing having a plurality of outwardly open plug receptacles separated from each other by contact supporting walls and elongated inwardly extending electrical contact bars supported by said contact supporting walls, and a plurality of individually insulated electrical conductors extending into said connector housing, each of said conductors being terminated within the housing by an associated one of said contact bars.

14. A method for making an electrical connector assembly comprising the steps of providing a hollow dielectric connector housing having a plurality of substantially parallel spaced apart contact supporting walls partially defining an in-line array of outwardly open plug receptacles and formed by mating connector housing sections, one mating connector housing section having an integral cradle therein defining crimp barrels, another mating housing section having an integral energy director cap for cooperating with said cradle when the mating housing sections are joined together in assembly, providing a plurality of elongated plugging electrical contacts, positioning each of said contacts on an associated one of said contact supporting walls of the one housing section with said contacts extending into the one housing section and into the crimp barrels, therein arranging a plurality of electrical conductors with each conductor within an associated crimp barrel and in overlying relation with an associated electrical contact, positioning the another mating connector housing section in mating engagement with the one connector housing section, to form a preassembled connector assembly, simultaneously applying force of a predetermined magnitude and ultrasonic vibratory energy to the preassembled connector assembly to move the one and the another housing sections toward and into mating engagement with each other to secure the contacts between opposing contact supporting walls and to simultaneously ultrasonically weld the energy director cap to the cradle and the mating connector housing sections in assembled relation to each other.

15. A method for making a connector assembly as set forth in claim 14 comprising the steps of maintaining the preassembled connector housing assembly under compression after ceasing application of high frequency vibratory energy and until the welds joining the mating connector housing sections and the cradle and energy director cap have solidified.

16. A method for making a connector assembly as set forth in claim 14 wherein the electrical conductors are insulated conductors and the step of simultaneously applying force and ultrasonic vibratory energy to the preassembled connector assembly simultaneously melts insulation from the conductors to establish electrical connection between the conductors and the contacts.

17. A method for making a connector assembly as set forth in claim 16 wherein the electrical conductors comprise part of a cable having an insulation jacket and the step of simultaneously applying force and ultrasonic vibratory energy simultaneously welds the insulation jacket to the connector housing sections.

* * * * *